US009294837B2

(12) United States Patent
Sakamoto et al.

(10) Patent No.: US 9,294,837 B2
(45) Date of Patent: Mar. 22, 2016

(54) VEHICULAR ACTIVE VIBRATIONAL NOISE CONTROL APPARATUS

(71) Applicant: HONDA MOTOR CO., LTD., Minato-Ku, Tokyo (JP)

(72) Inventors: Kosuke Sakamoto, Utsunomiya (JP); Toshio Inoue, Tochigi-Ken (JP); Satoru Kikuchi, Utsunomiya (JP); Takanori Yamamoto, Tochigi-Ken (JP)

(73) Assignee: Honda Motor Co., Ltd., Tokyo (JP)

( * ) Notice: Subject to any disclaimer, the term of this patent is extended or adjusted under 35 U.S.C. 154(b) by 120 days.

(21) Appl. No.: 14/220,253

(22) Filed: Mar. 20, 2014

(65) Prior Publication Data

US 2014/0286505 A1 Sep. 25, 2014

(30) Foreign Application Priority Data

Mar. 21, 2013 (JP) ..... 2013-058855

(51) Int. Cl.
*G10K 11/16* (2006.01)
*H04R 3/00* (2006.01)
*G10K 11/178* (2006.01)

(52) U.S. Cl.
CPC ..... *H04R 3/002* (2013.01); *G10K 11/1788* (2013.01); *G10K 2210/12821* (2013.01); *G10K 2210/3014* (2013.01); *G10K 2210/3039* (2013.01); *G10K 2210/3056* (2013.01)

(58) Field of Classification Search
None
See application file for complete search history.

(56) References Cited

U.S. PATENT DOCUMENTS

| | | | | |
|---|---|---|---|---|
| 5,524,057 | A * | 6/1996 | Akiho | G10K 11/1786 381/71.11 |
| 5,617,315 | A | 4/1997 | Nakao et al. | |
| 5,690,321 | A | 11/1997 | Seni et al. | |
| 2004/0258252 | A1 | 12/2004 | Inoue et al. | |
| 2008/0292110 | A1 | 11/2008 | Kobayashi et al. | |
| 2009/0060217 | A1 * | 3/2009 | Sakamoto | G10K 11/178 381/71.4 |
| 2010/0260345 | A1 | 10/2010 | Shridhar et al. | |
| 2011/0206213 | A1 * | 8/2011 | Sakamoto | G10K 11/1782 381/71.4 |
| 2013/0136270 | A1 * | 5/2013 | Sakamoto | G10K 11/16 381/71.4 |
| 2013/0315409 | A1 * | 11/2013 | Inoue | G10K 11/1784 381/71.1 |

FOREIGN PATENT DOCUMENTS

| | | | |
|---|---|---|---|
| EP | 2 375 408 | A2 | 10/2011 |
| JP | 2008-137636 | A | 6/2008 |
| JP | 2009-045955 | A | 3/2009 |

OTHER PUBLICATIONS

Extended European search report dated Oct. 22, 2014 issued over the corresponding EP Patent Application No. 14 15 9425.9.

* cited by examiner

*Primary Examiner* — Thang Tran
(74) *Attorney, Agent, or Firm* — Carrier Blackman & Associates, P.C.; Joseph P. Carrier; Jeffrey T. Gedeon

(57) ABSTRACT

A vehicular active vibrational noise control apparatus includes an amplitude limiter for limiting the amplitude of a canceling signal based on a signal level of an audio signal, and a vehicle speed detector for detecting the vehicle speed of a vehicle, which incorporates therein the vehicular active vibrational noise control apparatus. The amplitude limiter changes an amplitude limitation rule, which represents a relationship of a limiting value for the amplitude of the canceling signal to the signal level, depending on the vehicle speed, and limits the amplitude of the canceling signal based on the limiting value determined according to the amplitude limitation rule.

5 Claims, 10 Drawing Sheets

(COMPARATIVE EXAMPLE)

PRIOR ART

VEHICULAR ACTIVE VIBRATIONAL NOISE CONTROL APPARATUS

CROSS-REFERENCE TO RELATED APPLICATION

This application is based upon and claims the benefit of priority from Japanese Patent Application No. 2013-058855 filed on Mar. 21, 2013, the contents of which are incorporated herein by reference.

BACKGROUND OF THE INVENTION

1. Field of the Invention

The present invention relates to a vehicular active vibrational noise control apparatus for canceling vibrational noise produced in a passenger compartment of a vehicle during traveling of the vehicle, using canceling vibrational noise that is emitted in the passenger compartment.

2. Description of the Related Art

Recently, there has been proposed an active vibrational noise control apparatus (hereinafter also referred to as an "ANC (Active Noise Control) apparatus"), which cancels vibrational noise produced in a passenger compartment of a vehicle during traveling of the vehicle, by emitting, from a speaker, a vibrational noise canceling sound that is in opposite phase to the vibrational noise, in combination with music sounds based on an audio signal.

Japanese Laid-Open Patent Publication No. 2009-045955 discloses an ANC apparatus, which is capable of compensating with high accuracy a reduction in quality of an audio sound based on an audio signal, by extracting a component around the frequency of road noise from the audio signal, and performing appropriate signal processing on the extracted component.

According to Japanese Laid-Open Patent Publication No. 2008-137636, there is proposed an ANC apparatus for adjusting the amplitude of a canceling signal based on the signal level of an audio signal (hereinafter also referred to as a "signal level") or the vehicle speed of a vehicle that incorporates the apparatus therein. For example, according to Japanese Laid-Open Patent Publication No. 2008-137636, the amplitude of the canceling signal is adjusted to nil if a condition is satisfied, for example, in which the vehicle speed is zero or the audio signal level is greater than a predetermined value.

SUMMARY OF THE INVENTION

According to the description concerning FIGS. 2A through 2C of Japanese Laid-Open Patent Publication No. 2008-137636, the amplitude of the canceling signal is determined by multiplying a first gain depending on the vehicle speed and a second gain depending on the signal level. When the signal level is greater than a predetermined threshold value, for example, the second gain falls to nil.

However, even if the vehicle speed becomes sufficiently large such that the road noise is increased, since the amplitude of the canceling signal is nil at all times, the ANC apparatus maintains the ANC process in an off state. Therefore, much remains to be improved for performing a finely tuned ANC process, which takes into account the relationship between vehicle speed and signal level.

The present invention has been made to solve the above problem, and it is an object of the present invention to provide a vehicular active vibrational noise control apparatus, which is capable of performing a finely tuned ANC process while taking into account the relationship between the vehicle speed and the audio signal level.

According to the present invention, there is provided a vehicular active vibrational noise control apparatus comprising canceling signal generating means for generating a canceling signal for canceling road noise based on a reference signal related to the road noise, audio signal generating means for generating an audio signal, a mixer for mixing the canceling signal and the audio signal into a mixed signal, sound output means for outputting the mixed signal, detecting means for detecting the mixed signal, which is made up from the audio signal and remaining vibrational noise due to interference between the canceling signal and the road noise at an evaluation point, audio signal level detecting means for detecting a signal level of the audio signal in the vicinity of a frequency of the reference signal, amplitude limiting means for limiting the amplitude of the canceling signal based on the signal level, and vehicle speed detecting means for detecting a vehicle speed of the vehicle. The amplitude limiting means changes an amplitude limitation rule, which represents a relationship of a limiting value for the amplitude of the canceling signal to the signal level, depending on the vehicle speed, and limits the amplitude of the canceling signal based on the limiting value determined according to the amplitude limitation rule.

Since the vehicular active vibrational noise control apparatus includes the amplitude limiting means that changes the amplitude limitation rule, which represents a relationship of the limiting value for the amplitude of the canceling signal to the signal level of the audio signal, based on the vehicle speed, and limits the amplitude of the canceling signal based on the limiting value determined according to the amplitude limitation rule, a limiting value can be determined that matches respective changes in the vehicle speed and the signal level. Accordingly, the vehicular active vibrational noise control apparatus is capable of performing a finely tuned ANC process while taking into account the relationship between the vehicle speed and the signal level.

Preferably, the amplitude limitation rule represents a function identified by at least one coefficient, and the amplitude limiting means changes the at least one coefficient depending on the vehicle speed, so as to limit the amplitude of the canceling signal. With the amplitude limitation rule being expressed by such a function, characteristics of the amplitude limitation rule can easily be changed by changing at least one coefficient of the function.

Preferably, the amplitude limitation rule represents a plurality of table values indicative of the limiting value for the signal level, and the amplitude limiting means changes at least one of the table values depending on the vehicle speed, so as to limit the amplitude of the canceling signal. With the amplitude limitation rule being expressed by a table, characteristics of the amplitude limitation rule can easily be changed by changing the table values.

The vehicular active vibrational noise control apparatus preferably further comprises second canceling signal generating means for generating a second canceling signal for an event different from the road noise, a second mixer for mixing the canceling signal and the second canceling signal into a mixed canceling signal, and amplitude adjusting means for adjusting the amplitude of the second canceling signal depending on the amplitude of the canceling signal limited by the amplitude limiting means. The vehicular active vibrational noise control apparatus, which is arranged in the foregoing manner, is capable of generating a mixed canceling signal that matches the characteristics of the output range of the second mixer.

According to the present invention, there also is provided a vehicular active vibrational noise control apparatus comprising a canceling signal generator for generating a canceling signal for canceling road noise based on a reference signal related to the road noise, an audio signal generator for generating an audio signal, a mixer for mixing the canceling signal and the audio signal into a mixed signal, a sound output unit for outputting the mixed signal, a detector for detecting the mixed signal, which is made up from the audio signal and remaining vibrational noise due to interference between the canceling signal and the road noise at an evaluation point, an audio signal level detector for detecting a signal level of the audio signal in the vicinity of a frequency of the reference signal, an amplitude limiter for limiting the amplitude of the canceling signal based on the signal level, and a vehicle speed detector for detecting a vehicle speed of the vehicle. The amplitude limiter changes an amplitude limitation rule, which represents a relationship of a limiting value for the amplitude of the canceling signal to the signal level, depending on the vehicle speed, and limits the amplitude of the canceling signal based on the limiting value determined according to the amplitude limitation rule.

Since the vehicular active vibrational noise control apparatus according to the present invention includes the amplitude limiter that changes the amplitude limitation rule, which represents a relationship of the limiting value for the amplitude of the canceling signal to the signal level of the audio signal, based on the vehicle speed, and limits the amplitude of the canceling signal based on the limiting value determined according to the amplitude limitation rule, a limiting value can be determined that matches respective changes in the vehicle speed and the signal level. Accordingly, the vehicular active vibrational noise control apparatus is capable of performing a finely tuned ANC process while taking into account the relationship between the vehicle speed and the signal level.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

A vehicular active vibrational noise control apparatus according to a preferred embodiment of the present invention will be described below with reference to the accompanying drawings.

[Overall Arrangement of ANC Apparatus 10]

Figure 1:
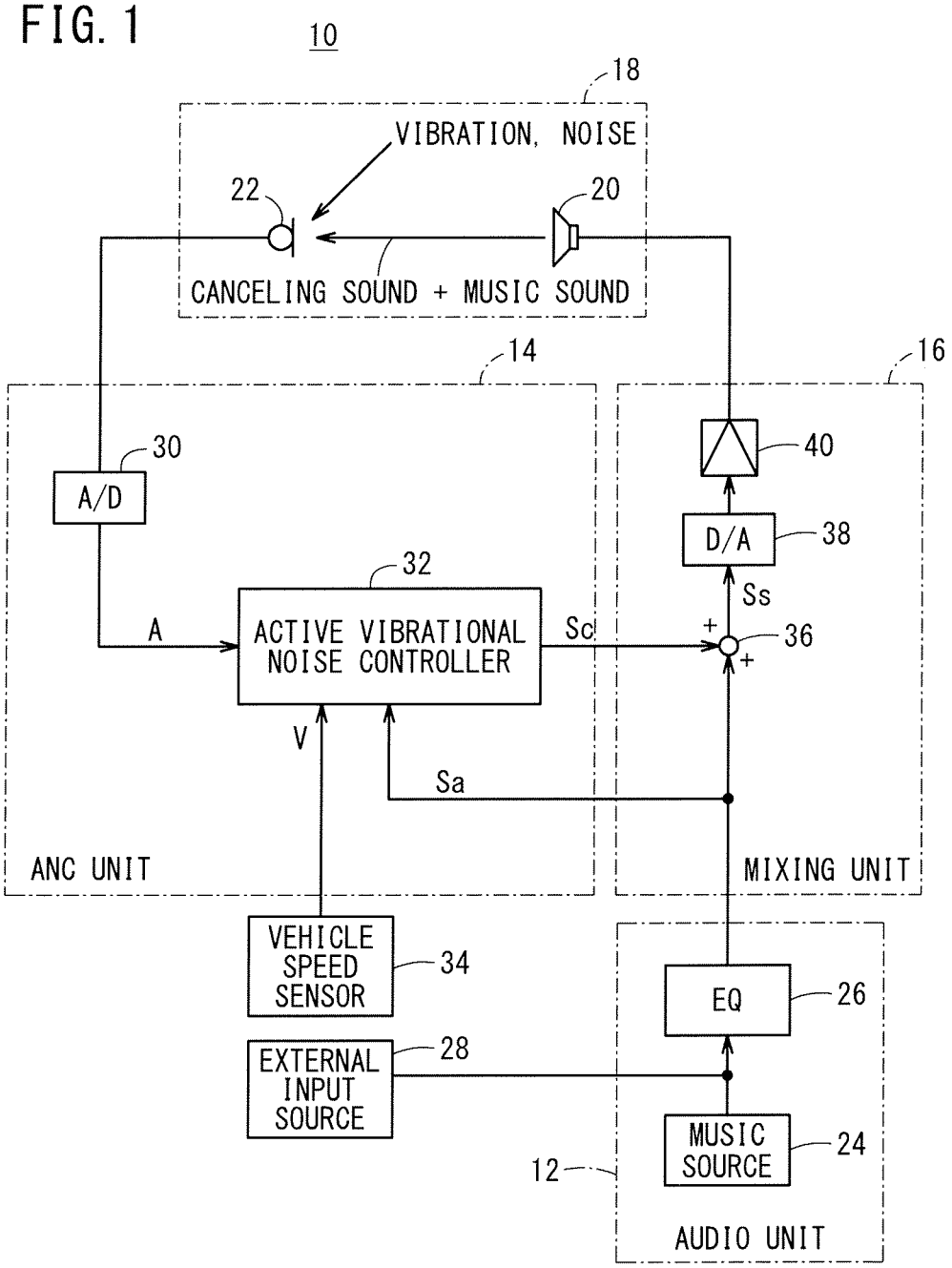
FIG. 1 is a block diagram of a vehicular active vibrational noise control apparatus according to an embodiment of the present invention.

FIG. 1 shows in block form a vehicular active vibrational noise control apparatus 10 (hereinafter referred to as an "ANC apparatus 10") according to an embodiment of the present invention.

As shown in FIG. 1, the ANC apparatus 10 basically comprises an audio unit 12 (audio signal generating means, audio signal generator), an ANC unit 14, a mixing unit 16, at least one speaker 20 (sound output means, sound output unit), and at least one microphone 22 (detecting means, detector). The speaker 20 and the microphone 22 are disposed in a passenger compartment 18 of a vehicle.

The audio unit 12 generates an audio signal Sa for generating a musical sound. The audio unit 12 includes a music source 24 such as a tuner, a compact disc, or the like, and an equalizer 26 for processing and adjusting the frequency characteristics of a signal generated by the music source 24. Instead of the music source 24, the audio unit 12 may be supplied with an audio signal from an external input source 28.

The ANC unit 14 carries out an ANC process for implementing a predetermined signal processing sequence on an error signal A, which is supplied from the microphone 22, in order to generate a canceling signal Sc. The canceling signal Sc is supplied to the speaker 20 in order to emit canceling vibrational noise into the passenger compartment 18, for thereby actively canceling vibrational noise in the passenger compartment 18. The ANC unit 14 includes an A/D converter 30 for converting the error signal A, which is an analog signal, into a digital signal, and an active vibrational noise controller 32, which will be described in detail later.

The ANC unit 14 is implemented by a microcomputer, a DSP (Digital Signal Processor), or the like. When a CPU, which includes a microcomputer, a DSP, or the like, executes a program stored in a memory such as a ROM or the like based on various signals supplied to the CPU, the CPU performs various processing sequences. The ANC unit 14 is connected to a vehicle speed sensor 34 (vehicle speed detecting means, vehicle speed detector). The active vibrational noise controller 32 acquires a vehicle speed V through the vehicle speed sensor 34.

The mixing unit 16 generates a mixed signal Ss by mixing the audio signal Sa from the audio unit 12 and the canceling signal Sc from the ANC unit 14. The mixing unit 16 includes a mixer 36 for generating the mixed signal Ss, a D/A converter 38 for converting the mixed signal Ss, which is a digital signal, into an analog signal, and an amplifier 40 for amplifying the analog signal from the D/A converter 38.

The speaker 20 produces and radiates canceling vibrational noise into the passenger compartment 18 based on the output signal, i.e., the mixed signal Ss, from the mixing unit 16. More specifically, the speaker 20 produces and radiates canceling vibrational noise that is opposite in phase with the vibrational noise, which has a main component having a predetermined frequency, in the passenger compartment 18, thereby reducing the vibrational noise in the passenger compartment 18 based on interference between sound waves. The speaker 20 is positioned in the vicinity of a kick panel near a passenger seat in the passenger compartment 18.

The microphone 22 detects various sounds that are produced in the passenger compartment 18. The sounds detected by the microphone 22 include vibrational noise caused by vibrations of the road wheels of the vehicle as the road wheels roll on a road, and canceling vibrational noise for canceling the vibrational noise. The microphone 22 detects a mixed signal, which represents a mixture of residual vibrational noise generated from interference between the vibrational noise and the canceling vibrational noise at an evaluation point, and a music sound based on the audio signal Sa. The mixed signal is supplied as the error signal A to the ANC unit 14. The microphone 22 is positioned in an upper region of the passenger compartment 18, or more specifically, is positioned in the vicinity of a passenger hearing point in the passenger compartment 18.

Examples of events that generate vibrational noise in the passenger compartment 18 include road noise, muffled engine sounds, and muffled propeller shaft sounds. The term "road noise" refers to noise that is transmitted from the road through the road wheels and the vehicle suspension. The term "muffled engine sounds" refers to muffled sounds produced by combustion chambers of the vehicle engine. The term "muffled propeller shaft sounds" refers to muffled sounds that are caused due to the eccentricity of a rotating power train system including a propeller shaft.

[Active Vibrational Noise Controller 32]

Figure 2:
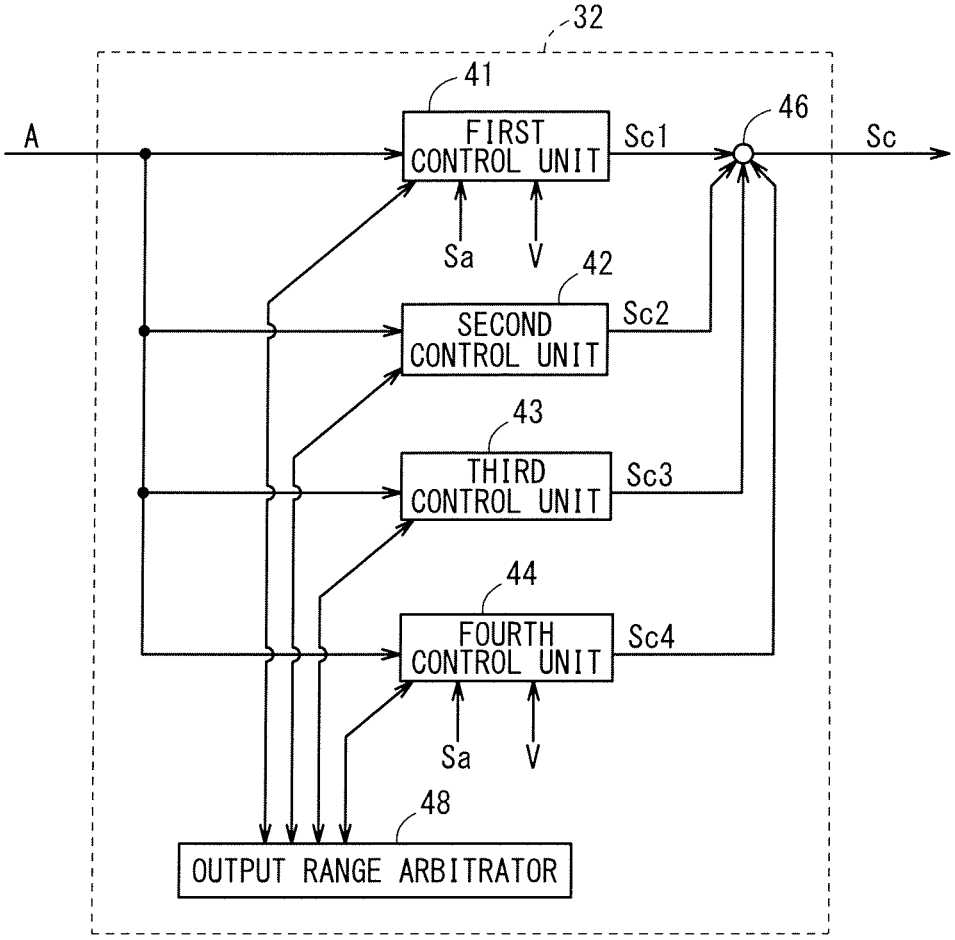
FIG. 2 is a block diagram of an active vibrational noise controller shown in FIG. 1.

FIG. 2 shows in block form the active vibrational noise controller 32 shown in FIG. 1. As shown in FIG. 2, the active vibrational noise controller 32 includes a first control unit 41, a second control unit 42 (second canceling signal generating means), a third control unit 43, a fourth control unit 44, a mixer 46 (second mixer), and an output range arbitrator 48 (amplitude adjusting means).

The first control unit 41 is supplied with the error signal A from the A/D converter 30 (see FIG. 1) and generates a first canceling signal Sc1 for canceling first road noise, e.g., low-frequency road noise having a frequency of about 40 Hz. The second control unit 42 is supplied with the error signal A from the A/D converter 30, and generates a second canceling signal Sc2 for canceling muffled engine sounds. The third control unit 43 is supplied with the error signal A from the A/D converter 30, and generates a third canceling signal Sc3 for canceling muffled propeller shaft sounds. The fourth control unit 44 is supplied with the error signal A from the A/D converter 30, and generates a fourth canceling signal Sc4 for canceling second road noise, e.g., high-frequency road noise having a frequency of about 125 Hz.

The mixer 46 is supplied with the first canceling signal Sc1, the second canceling signal Sc2, the third canceling signal Sc3, and the fourth canceling signal Sc4, and mixes them into the canceling signal Sc.

The output range arbitrator 48 is connected to the first through fourth control units 41 through 44, and performs an arbitration process for arbitrating an output range DR(i), to be described later.

[First Control Unit 41]

Figure 3:
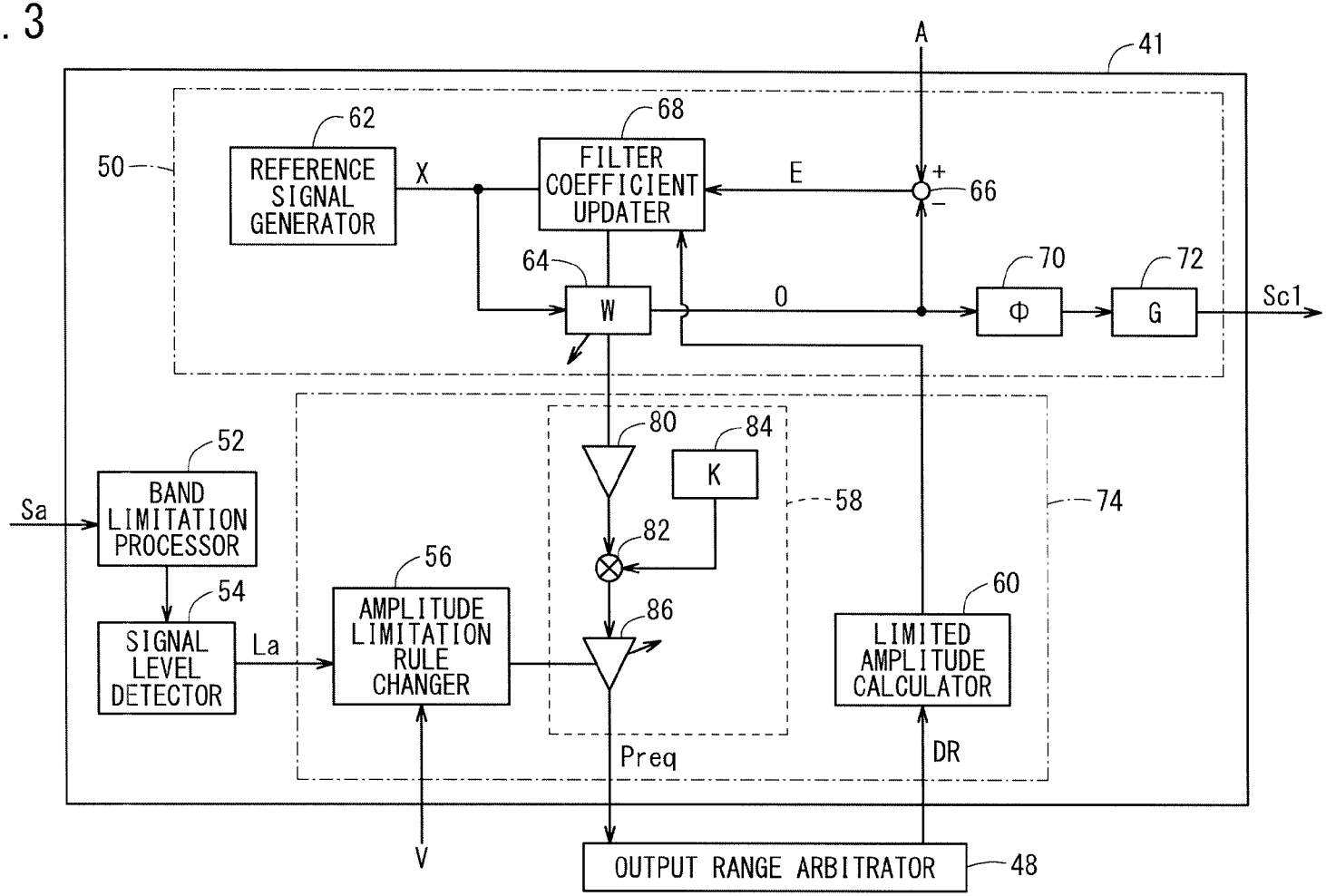
FIG. 3 is a detailed block diagram of a first control unit shown in FIG. 2.

FIG. 3 shows in detailed block form the first control unit 41 shown in FIG. 2. As shown in FIG. 3, the first control unit 41 includes a canceling signal generator 50 (canceling signal generating means), a band limitation processor 52, a signal level detector 54 (audio signal level detecting means), an amplitude limitation rule changer 56, a required amplitude calculator 58, and a limited amplitude calculator 60.

The canceling signal generator 50 includes a reference signal generator 62 that generates a reference signal X including a main component having a target frequency of 40 Hz, for example, and an adaptive notch filter 64 for performing a SAN (Single Adaptive Notch) filtering process on the generated reference signal X.

The canceling signal generator 50 also includes a subtractor 66 for subtracting a control signal O from the adaptive notch filter 64 from the error signal A in order to generate a corrected error signal E, and a filter coefficient updater 68 for sequentially updating filter coefficients W of the adaptive notch filter 64 in order to minimize the corrected error signal E.

The canceling signal generator 50 further includes a phase adjuster 70 for adjusting the phase of the control signal O from the adaptive notch filter 64, and a gain adjuster 72 for adjusting the gain of the control signal O.

The amplitude limitation rule changer 56, the required amplitude calculator 58, and the limited amplitude calculator 60 function collectively as an amplitude limiting means 74 (hereinafter referred to as an "amplitude limiter 74") for limiting the amplitude of the first canceling signal Sc1.

As shown in FIG. 3, the canceling signal generator 50 is constructed using a SAN filter. However, the canceling signal generator 50 may instead be constructed using an FIR (Finite Impulse Response) filter or an IIR (Infinite Impulse Response) filter. Each of the second control unit 42, the third control unit 43, and the fourth control unit 44 performs functions that are identical or equivalent to those of the canceling signal generator 50 and the amplitude limiter 74 of the first control unit 41.

[Operations of Amplitude Limiter 74]

Figure 4:
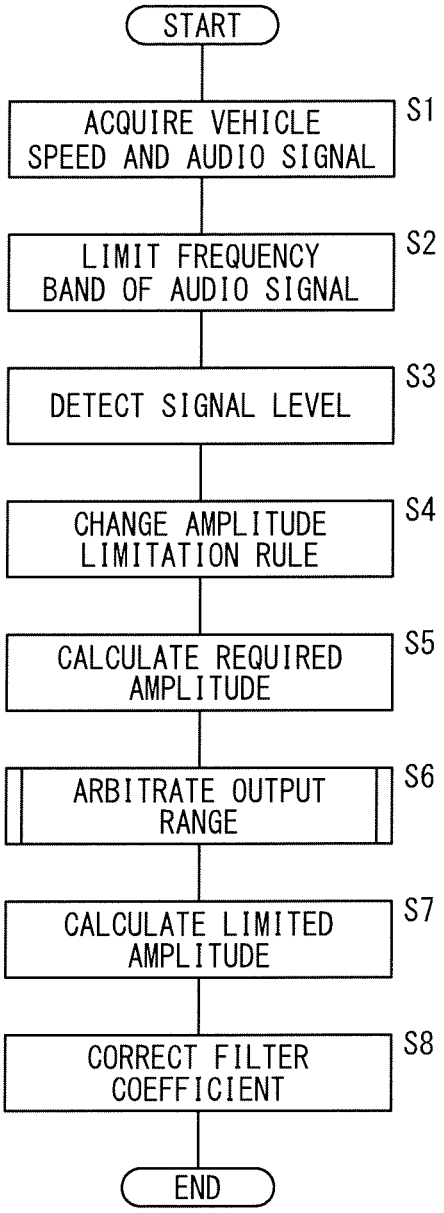
FIG. 4 is a flowchart of an operation sequence of the first control unit shown in FIG. 3.

An operation sequence of the first control unit 41 shown in FIG. 3, in particular the amplitude limiter 74 thereof, will be described below primarily with reference to the flowchart shown in FIG. 4.

In step S1, the first control unit 41 acquires the vehicle speed V from the vehicle speed sensor 34, and also acquires the audio signal Sa from the audio unit 12.

In step S2, the band limitation processor 52 performs a filtering process on the audio signal Sa acquired in step S1, so as to limit the frequency band of the audio signal Sa. The band limitation processor 52 may apply an FIR filtering process, an IIR filtering process, or a SAN filtering process.

Figure 5:
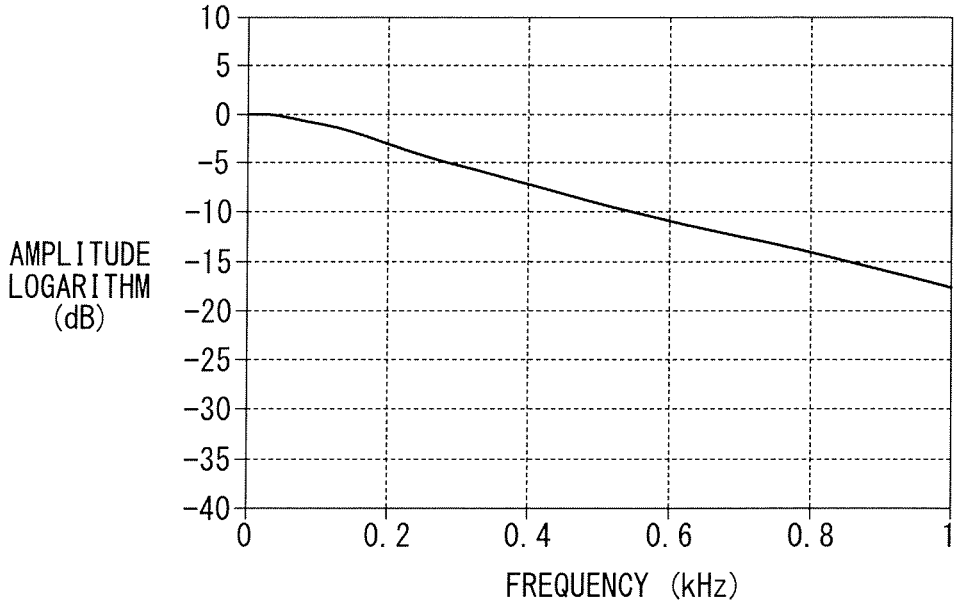
FIG. 5 is a graph showing by way of example a response characteristic curve of a filter that acts on an audio signal.

FIG. 5 is a graph showing by way of example a response characteristic curve of a filter that acts on the audio signal Sa. The graph has a horizontal axis representing frequencies (units: kHz), and a vertical axis representing frequency logarithms (units: dB). It is desirable to extract several components in a low-frequency range that affects the quality of music sounds. The filter that acts on the audio signal Sa has characteristics such that components in a higher-frequency range are attenuated to a greater degree, whereas components in a lower-frequency range are attenuated to a lesser degree.

In step S3, based on the signal filtered in step S2 (hereinafter referred to as a "low-frequency-range audio signal"), the signal level detector 54 detects a signal level La of the audio signal Sa. A process for detecting the signal level La will be described below with reference to FIGS. 6A through 6C.

Figure 6A:
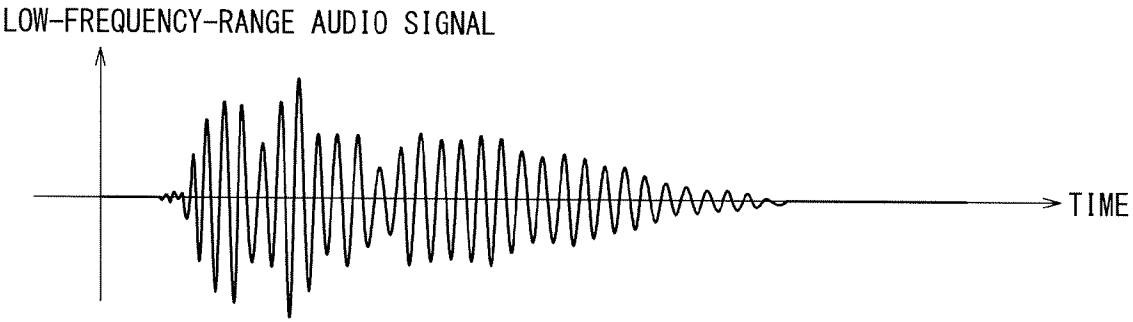
FIGS. 6A through 6C are graphs illustrative of a process for detecting a signal level.

FIG. 6A is a graph showing by way of example the waveform of a low-frequency-range audio signal. Since the audio signal Sa is an AC signal, the sign thereof varies periodically.

Figure 6B:
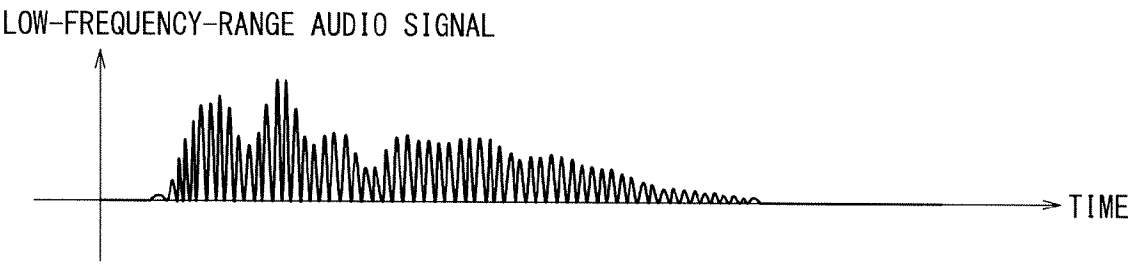

As shown in FIG. 6B, the signal level detector 54 calculates an absolute value of the audio signal Sa, and detects respective peak values, which are measured according to a peak-hold function, as the signal level La of the audio signal Sa.

Figure 6C:
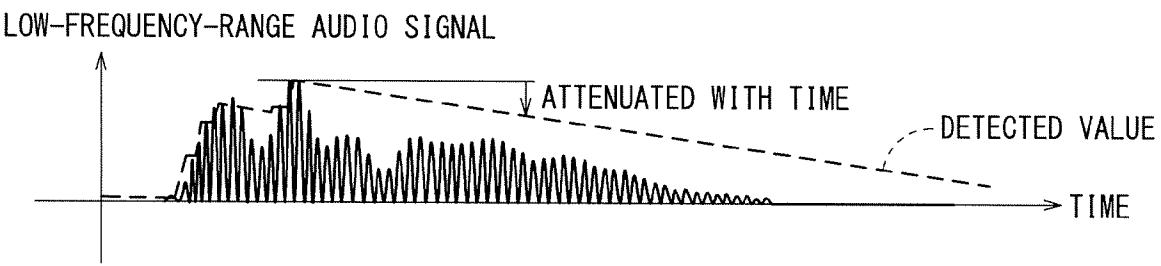

As indicated by the broken-line curve in FIG. 6C, while the peak value tends to increase, the signal level detector 54 employs respective values thereof as the signal level La.

While the peak value tends to decrease, the signal level detector 54 estimates the signal level La based on a mathematical model in which the peak value deteriorates over time from a maximum level. For illustrative purposes, the signal level La is normalized in a range of [0, 1].

In step S4, the amplitude limitation rule changer 56 changes an amplitude limitation rule depending on the vehicle speed V acquired in step S1. The amplitude limitation rule refers to a rule, which represents the relationship of a limiting value C for the amplitude of a canceling signal (first canceling signal Sc1) to the signal level La of the audio signal Sa. The limiting value C refers to a parameter for determining a degree to which the amplitude is limited, and may be defined as desired. According to the present embodiment, the limiting value C is defined by way of a percentage (%). In this case, if the limiting value C is C=100(%), the amplitude of the first canceling signal Sc1 is not limited at all, and if the limiting value C is C=0(%), the amplitude of the first canceling signal Sc1 is fully limited.

A first process for determining the limiting value C will be described below with reference to FIGS. 7A and 7B. According to the first process, the amplitude limitation rule is represented by a function (linear or nonlinear), which is identified by at least one coefficient. As one example, the amplitude limitation rule is described using a step function Θ (Th−La) having a threshold value Th as one coefficient thereof. The step function Θ is Θ=1 (100%) when an argument of the step function is of a positive value, and is Θ=0 (0%) otherwise.

Figure 7A:
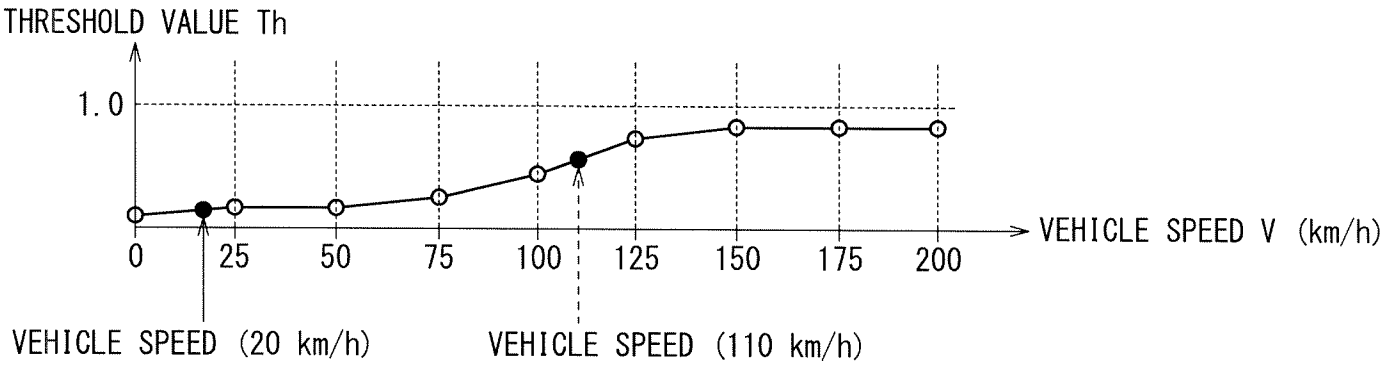
FIGS. 7A and 7B are graphs illustrative of a first process for determining a limiting value.

FIG. 7A is a graph showing by way of example the relationship of the threshold Th (units: none) to the vehicle speed V (units: km/h). As can be seen from FIG. 7A, in a vehicle speed range from 50 to 150 km/h, the threshold value Th increases as the vehicle speed V increases. For example, it is assumed that if the vehicle speed V is V=20 km/h, the threshold value Th is Th=0.19, and if the vehicle speed V is V=110 km/h, the threshold value Th is Th=0.56.

Figure 7B:
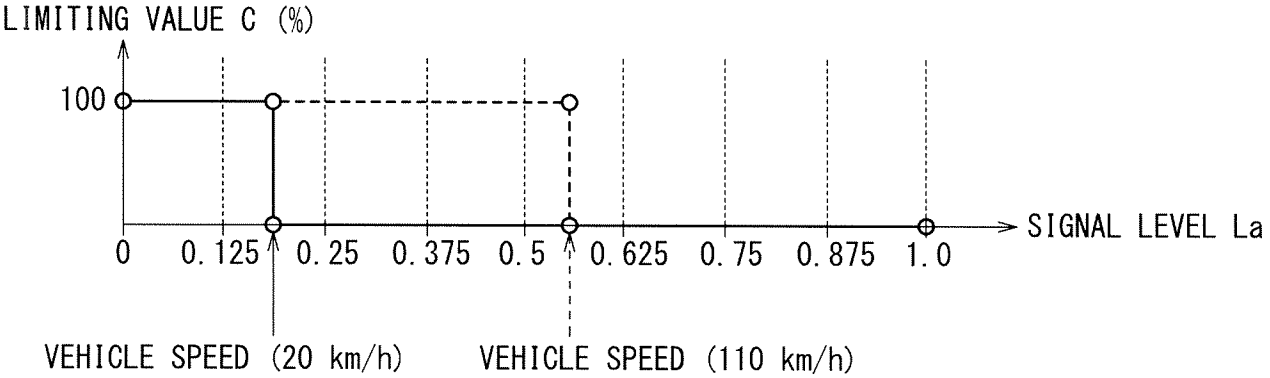

FIG. 7B is a graph showing by way of example the relationship of the limiting value C (units: %) to the signal level La (units: none). As can be seen from FIG. 7B, the characteristic of the limiting value C varies depending on the vehicle speed V. More specifically, as the vehicle speed V becomes lower, the amplitude limiting range is wider, and as the vehicle speed V becomes higher, the amplitude limiting range is narrower.

A second process for determining the limiting value C will be described below with reference to FIGS. 8A and 8B. According to the second process, the amplitude limiting rule is represented by a plurality of table values, which indicate the limiting value C for the signal level La.

Figure 8A:
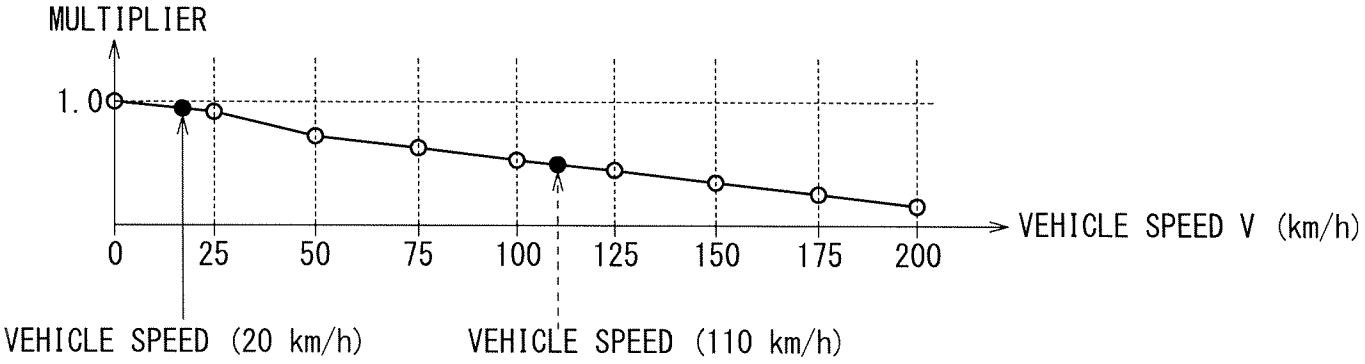
FIGS. 8A and 8B are graphs illustrative of a second process for determining a limiting value.

FIG. 8A is a graph showing by way of example a relationship of a multiplier (units: none) to the vehicle speed V (units: km/h). The multiplier corresponds to a multiplying coefficient for the signal level La. As can be understood from FIG. 8A, there are nine table values representing vehicle speeds V spaced at intervals of 25 km/h. The multiplier becomes greater as the vehicle speed V is lower.

Figure 8B:
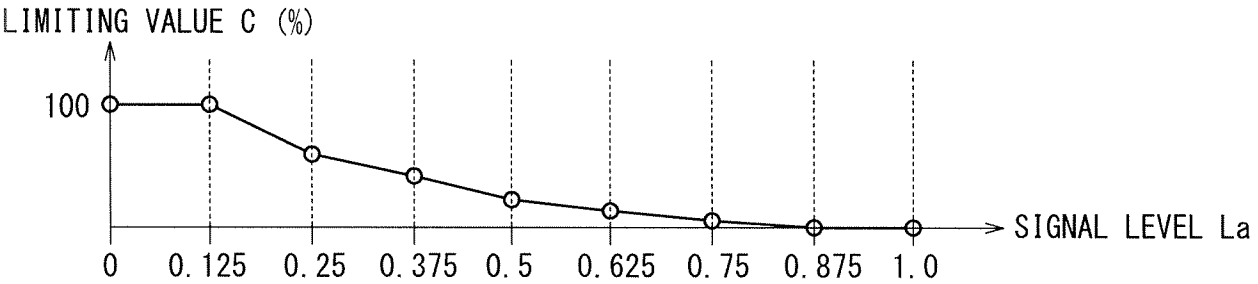

FIG. 8B is a graph showing by way of example respective table values for the limiting value C (units: %). As can be understood from FIG. 8B, there are nine table values representing signal levels La spaced at intervals of 0.125. In a signal level range equal to or greater than a signal level La of 0.125, the limiting value C decreases as the signal level La increases.

According to the second process, the signal level La changes depending on the vehicle speed V and the amplitude is limited using one common table. The results obtained according to the second process are the same as those obtained according to the first process. Stated otherwise, as the vehicle speed V becomes lower, the multiplied signal level La is relatively greater, thereby limiting the amplitude to a smaller degree. As the vehicle speed V becomes higher, the multiplied signal level La is relatively smaller, thereby limiting the amplitude to a greater degree.

The amplitude limitation rule is not limited to the first and second processes shown in FIGS. 7A through 8B, but may employ any of various specific details. For example, the configuration of the function, the number of coefficients for identifying the function, the number of table points, the number of tables, definitions for the limiting value C, the applied range of vehicle speeds V, etc., may be varied as desired.

In step S5, the required amplitude calculator 58 calculates a required amplitude Preq based on the filter coefficients W (real number or complex number) of the adaptive notch filter 64. Prior to calculating the required amplitude Preq, the adaptive notch filter 64 supplies an absolute value |W| of a filter coefficient W at a particular frequency.

An amplifier 80 amplifies an input signal from the adaptive notch filter 64 by G, which corresponds to a gain value G of the gain adjuster 72. A multiplier 82 multiplies an input signal from the amplifier 80 by a margin coefficient K, which lies generally in the range of 1<K<2, and is read from a storage unit 84. A variable amplifier 86 sets the limiting value C supplied from the amplitude limitation rule changer 56, thereby attenuating the input signal from the multiplier 82 by C/100.

Therefore, the required amplitude Preq is calculated according to the following equation (1).

$$Preq=(C/100)\cdot K\cdot G\cdot|W| \quad (1)$$

For illustrative purposes, operations of the first control unit 41 have primarily been described above with respect to steps S1 through S5. However, if should be noted that the second control unit 42, the third control unit 43, and the fourth control unit 44 also operate to carry out steps S1 through S5 in synchronism or out of synchronism with the first control unit 41.

In step S6, the output range arbitrator 48 arbitrates an output range DR based on the required amplitude Preq calculated in step S5. Operational details of the output range arbitrator 48 will be described later.

In step S7, using an output range DR (e.g., i=1) obtained by the arbitration process in step S6, the limited amplitude calculator 60 calculates a limited amplitude for the first canceling signal Sc1. The limited amplitude is generally of a greater value as the output range DR increases. The limited amplitude calculator 60 supplies the calculated limited amplitude to the canceling signal generator 50, or more specifically, to the filter coefficient updater 68.

In step S8, the filter coefficient updater 68 corrects one of the filter coefficients W of the adaptive notch filter 64, i.e., a filter coefficient corresponding to a particular frequency, based on the limited amplitude calculated in step S7.

Thereafter, the operations of the amplitude limiter 74 are brought to an end. Similar to the case of steps S1 through S5 described above, the second control unit 42, the third control unit 43, and the fourth control unit 44 also operate to carry out steps S7 and S8 in synchronism or out of synchronism with the first control unit 41.

[Arbitration of Output Range DR(i)]

The arbitration process, which is performed in step S6 of FIG. 4, will be described in greater detail below with reference to the flowchart shown in FIG. 9. The arbitration process is used for mixing the first through fourth canceling signals Sc1 through Sc4 using the mixer 46 (see FIG. 2), the output range of which is fixed.

An output range assigned to an event i (i=1 through 4) will hereinafter be denoted by DR(i). In order to distinguish between respective events i, the suffix (i) may also be added to other symbols, including the required amplitude Preq.

Figure 9:
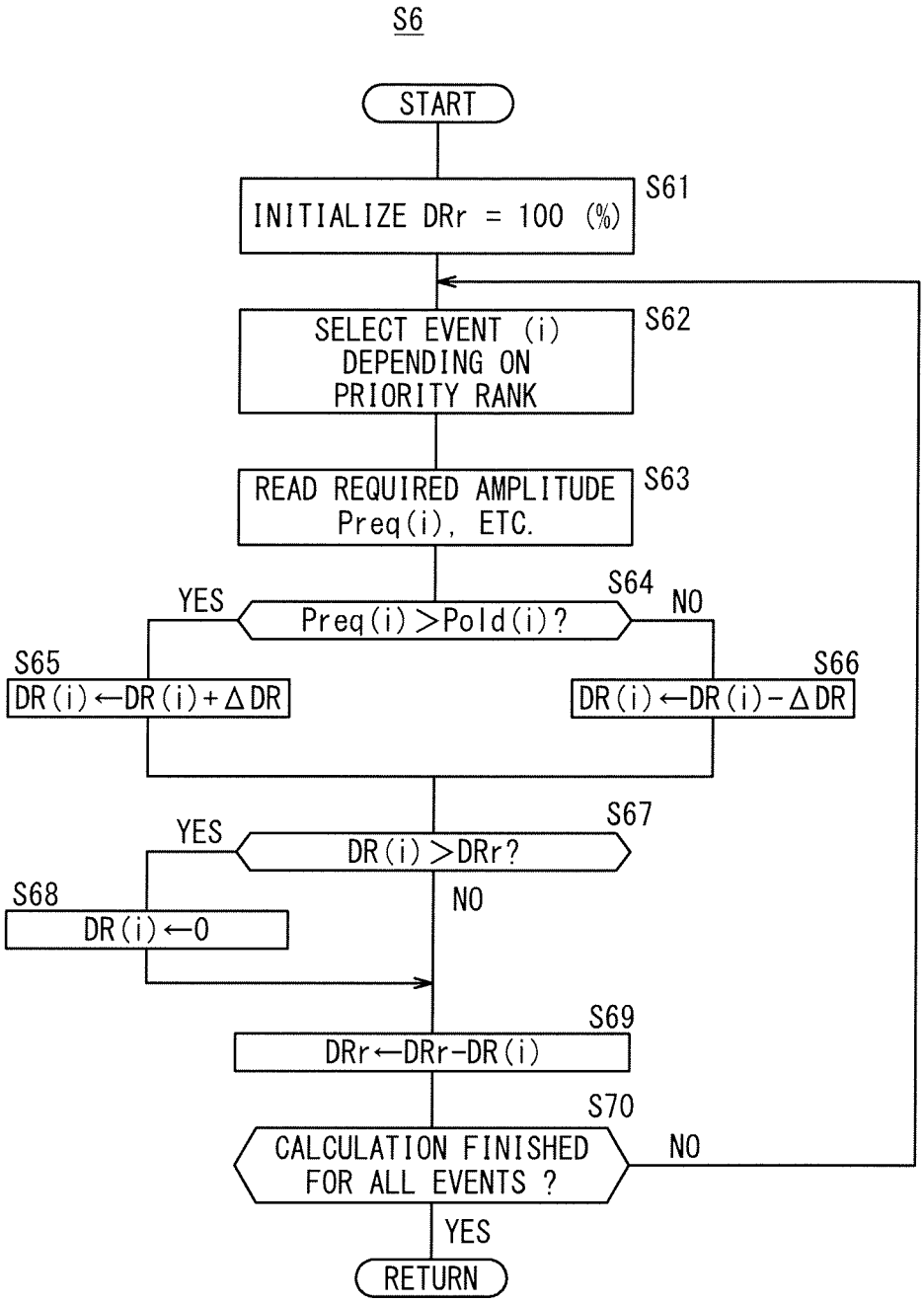
FIG. 9 is a flowchart of an operation sequence of an output range arbitrator shown in FIGS. 2 and 3.

In step S61 of FIG. 9, the output range arbitrator 48 performs an initializing process by setting a remaining output range DRr to DRr=100(%).

In step S62, the output range arbitrator 48 selects an event i that has not yet been selected, and which is of the highest priority rank.

In step S63, the output range arbitrator 48 reads the required amplitude Preq(i), which already has been calculated in step S5, along with the previous output range DR(i), etc.

In step S64, the output range arbitrator 48 compares the magnitudes of the required amplitude Preq(i) and a previous amplitude Pold(i) with each other. The previous amplitude Pold (without the suffix (i)) is calculated according to the following equation (2) shown below using a previous limiting value Cold and a previous filter coefficient Wold. It should be noted that, for calculating the previous amplitude Pold, the previous limiting value Cold and the previous filter coefficient Wold are not multiplied by the margin coefficient K.

$$Pold=(Cold/100)\cdot G\cdot|Wold| \quad (2)$$

If the condition Preq(i)>Pold(i) is satisfied (step S64: YES), then the output range arbitrator 48 calculates DR(i) ←DR(i)+ΔDR, thereby maintaining a certain output range ΔDR in step S65. If the condition Preq(i)>Pold(i) is not satisfied (step S64: NO), then the output range arbitrator 48 calculates DR(i)←DR(i)−ΔDR, thereby canceling a certain output range ΔDR in step S66.

In step S67, the output range arbitrator 48 compares the amplitudes of the updated output range DR(i) and the remaining output range DRr with each other. If the condition: DR(i) >DRr is satisfied (step S67: YES), then the output range arbitrator 48 calculates DR(i)←0, thereby canceling the output range DR(i) in its entirety in step S68. This is because the waveform of the canceling signal Sc may be crushed or distorted (clipped) due to a shortage of the output range DR(i).

In step S69, the output range arbitrator 48 performs the calculation DRr←DRr−DR(i), thereby updating the value of the remaining output range DRr.

In step S70, the output range arbitrator 48 judges whether or not the calculation of an output range DR(i) for all of the events (i) has been completed. If the output range arbitrator 48 determines that the calculation of an output range DR(i) has not been completed for all of the events (i) (step S70: NO), then control returns to step S62 and steps S62 through S69 are repeated. If the output range arbitrator 48 determines that the calculation of an output range DR(i) has been completed for all of the events (i) (step S70: YES), then in step S6 (see FIG. 4), the output range arbitrator 48 brings the arbitration process to an end.

Advantages of the Present Embodiment

The ANC apparatus 10 according to the present embodiment includes the canceling signal generator 50 that generates the first canceling signal Sc1 for canceling road noise based on the reference signal X related to the road noise, the audio unit 12 that generates the audio signal Sa, the mixer 36 that mixes the first canceling signal Sc1 and the audio signal Sa into the mixed signal Ss, the speaker 20 that radiates a sound based on the mixed signal Ss, and the microphone 22 that detects a mixed signal representing remaining vibrational noise, which is made up from the audio signal Sa and interference between the canceling signal Sc at the evaluation point, and the road noise.

The ANC apparatus 10 also includes the signal level detector 54 that detects the signal level La of the audio signal Sa in the vicinity of the frequency of the reference signal X, the amplitude limiter 74 that limits the amplitude of the first canceling signal Sc1 based on the signal level La, and the vehicle speed sensor 34 that detects the vehicle speed V. The amplitude limiter 74 changes the amplitude limitation rule, which represents the relationship of the limiting value C for the amplitude of the first canceling signal Sc1 to the signal level La, depending on the vehicle speed V, and limits the amplitude of the first canceling signal Sc1 based on the limiting value C determined according to the amplitude limitation rule.

The ANC apparatus 10 includes the amplitude limiter 74 that changes the amplitude limitation rule, which represents the relationship of the limiting value C for the amplitude of the first canceling signal Sc1 to the signal level La of the audio signal Sa, based on the vehicle speed V, and limits the amplitude of the first canceling signal Sc1 based on the limiting value C determined according to the amplitude limitation rule. Consequently, a limiting value C can be determined that matches respective changes in the vehicle speed V and the signal level La. Accordingly, the ANC apparatus 10 is capable of performing a finely tuned ANC process while taking into account the relationship between the vehicle speed V and the signal level La.

The advantages will be described in specific detail with reference to the graphs shown in FIGS. 10A and 10B. Each of the graphs shown in FIGS. 10A and 10B has a horizontal axis representing the vehicle speed V (0 through 200 km/h), and a vertical axis representing the signal level La (0 through 1).

Figure 10A:
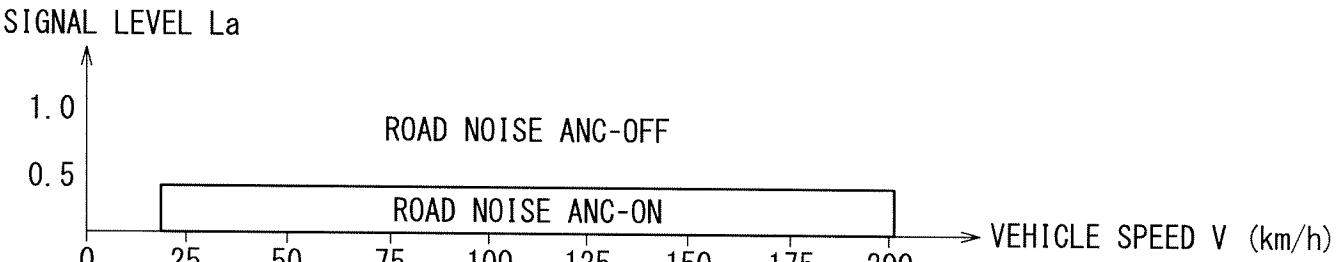
FIG. 10A is a graph showing the manner in which an ANC process according to a comparative example is carried out.

FIG. 10A shows the manner in which an ANC process is carried out according to a comparative example. FIG. 10A illustrates a gain curve, which also is shown in FIG. 2A of Japanese Laid-Open Patent Publication No. 2008-137636. As shown in FIG. 10A, the ANC process is turned on in a region in which the vehicle speed V is V>20 km/h and the signal level La is La<0.4, and is turned off in other regions. A threshold value (La=0.4) for the signal level La is determined based on a magnitude relationship between the signal level La and the lowest level of road noise that can be assumed, i.e., the magnitude of road noise produced when the vehicle speed V is V=20 km/h, at which the ANC apparatus 10 starts operating.

Figure 10B:
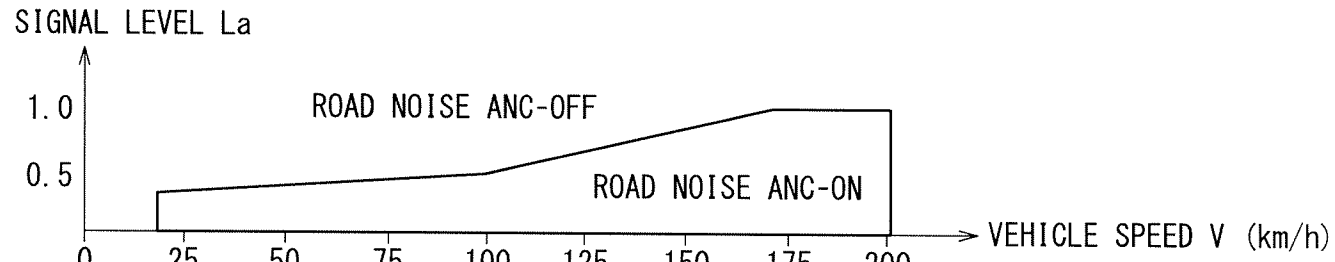
FIG. 10B is a graph showing the manner in which an ANC process according to the present embodiment is carried out.

FIG. 10B shows the manner in which the ANC process according to the present embodiment is carried out. As can be seen from FIG. 10B, the limit value for the signal level La, which serves to turn on the ANC process, increases as the vehicle speed V increases. Consequently, the ANC apparatus 10 is capable of performing a finely tuned ANC process while taking into account the relationship between the vehicle speed V and the signal level La.

The amplitude limitation rule represents a function, which is identified by at least one coefficient. The amplitude limiter 74 may change at least one coefficient of the function depending on the vehicle speed V, so as to limit the amplitude of the first canceling signal Sc1. If the amplitude limitation rule is expressed by a function, the characteristics of the amplitude limitation rule can easily be changed simply by changing at least one coefficient thereof.

The amplitude limitation rule represents a plurality of table values, which indicate the limiting value C for the signal level La. The amplitude limiter 74 may change at least one of the table values depending on the vehicle speed V, so as to limit the amplitude of the first canceling signal Sc1. If the amplitude limitation rule is expressed by a table, the characteristics of the amplitude limitation rule can easily be changed simply by changing the table values.

The active vibrational noise controller 32 may include the second control unit 42 (second canceling signal generating means), which generates the second canceling signal Sc2 for an event different from road noise (e.g., a muffled engine sound), the mixer 46 that mixes the first canceling signal Sc1 and the second canceling signal Sc2 into the mixed canceling signal, and the output range arbitrator 48 (amplitude adjusting means), which adjusts the amplitude of the second canceling signal Sc2 depending on the amplitude of the first canceling signal Sc1 as limited by the amplitude limiter 74. The active vibrational noise controller 32, which is arranged in the foregoing manner, is capable of generating a mixed canceling signal that matches the characteristics of the output range of the mixer 46.

Although a preferred embodiment of the present invention has been described above, it should be understood that the present invention is not limited to the above embodiment. Various changes and modifications may be made to the embodiment without departing from the scope of the invention as set forth in the appended claims.

What is claimed is:

1. A vehicular active vibrational noise control apparatus comprising:

canceling signal generating means for generating a canceling signal for canceling road noise based on a reference signal related to the road noise and additionally based on a detected mixed signal;

audio signal generating means for generating an audio signal;

a mixer for mixing the canceling signal and the audio signal into a mixed signal;

sound output means for outputting the mixed signal;

detecting means for detecting the mixed signal, which is made up from the audio signal and remaining vibrational noise due to interference between the canceling signal and the road noise at an evaluation point;

audio signal level detecting means for detecting a signal level of the audio signal in the vicinity of a frequency of the reference signal;

amplitude limiting means for limiting an amplitude of the canceling signal based on the signal level; and vehicle speed detecting means for detecting a vehicle speed of the vehicle, wherein the amplitude limiting means changes an amplitude limitation rule, which represents a relationship of a limiting value for the amplitude of the canceling signal to the signal level, depending on the vehicle speed, determines the limiting value corresponding the signal level in accordance with the amplitude limitation rule, and limits the amplitude of the canceling signal based on the determined limiting value.

2. The vehicular active vibrational noise control apparatus according to claim 1, wherein the amplitude limitation rule represents a function identified by at least one coefficient, and the amplitude limiting means changes the at least one coefficient depending on the vehicle speed, so as to limit the amplitude of the canceling signal.

3. The vehicular active vibrational noise control apparatus according to claim 1, wherein the amplitude limitation rule represents a plurality of table values indicative of the limiting value for the signal level, and the amplitude limiting means changes at least one of the table values depending on the vehicle speed, so as to limit the amplitude of the canceling signal.

4. The vehicular active vibrational noise control apparatus according to claim 1, further comprising:

second canceling signal generating means for generating a second canceling signal for an event different from the road noise;

a second mixer for mixing the canceling signal and the second canceling signal into a mixed canceling signal; and amplitude adjusting means for adjusting an amplitude of the second canceling signal depending on the amplitude of the canceling signal limited by the amplitude limiting means.

5. A vehicular active vibrational noise control apparatus comprising:

a canceling signal generator for generating a canceling signal for canceling road noise based on a reference signal related to the road noise and additionally based on a detected mixed signal;

an audio signal generator for generating an audio signal;

a mixer for mixing the canceling signal and the audio signal into a mixed signal;

a sound output unit for outputting the mixed signal;

a detector for detecting the mixed signal, which is made up from the audio signal and remaining vibrational noise due to interference between the canceling signal and the road noise at an evaluation point;

an audio signal level detector for detecting a signal level of the audio signal in the vicinity of a frequency of the reference signal;

an amplitude limiter for limiting an amplitude of the canceling signal based on the signal level; and a vehicle speed detector for detecting a vehicle speed of the vehicle, wherein the amplitude limiter changes an amplitude limitation rule, which represents a relationship of a limiting value for the amplitude of the canceling signal to the signal level, depending on the vehicle speed, determines the limiting value corresponding the signal level in accordance with the amplitude limitation rule, and limits the amplitude of the canceling signal based on the determined limiting value.

* * * * *